United States Patent [19]

Uemura et al.

[11] 4,391,788

[45] Jul. 5, 1983

[54] STARTING PITCHES FOR CARBON FIBERS

[75] Inventors: Seiichi Uemura, Tokyo; Shunichi Yamamoto; Takao Hirose, both of Kamakura; Hiroaki Takashima, Kawasaki; Osamu Kato, Yokohama; all of Japan

[73] Assignee: Nippon Oil Co., Ltd., Tokyo, Japan

[21] Appl. No.: 366,862

[22] Filed: Apr. 9, 1982

[30] Foreign Application Priority Data

Apr. 13, 1981 [JP] Japan ..... 56-54307
Jul. 27, 1981 [JP] Japan ..... 56-116332

[51] Int. Cl.[3] ..... D01F 9/12; C10C 3/02

[52] U.S. Cl. ..... 423/447.6; 208/40; 208/22

[58] Field of Search ..... 423/447.1, 447.2, 447.4, 423/447.6; 208/3, 4, 5, 6, 7, 22, 39, 40, 142, 23, 44

[56] References Cited

U.S. PATENT DOCUMENTS 3,928,170 12/1975 Takahashi et al. ..... 208/40
4,320,107 3/1982 Oyabu et al. ..... 423/447.6

*Primary Examiner*—O. R. Vertiz
*Assistant Examiner*—Steven Capella
*Attorney, Agent, or Firm*—Bucknam and Archer

[57] ABSTRACT

A starting pitch for carbon fibers, produced by heat treating at 400°-500° C. under a hydrogen pressure of at least 20 Kg/cm$^2$.G (1) a heavy fraction oil boiling at not lower than 200° C. obtained at the time of fluidized catalytic cracking of petroleum or (3) a mixture of the heavy fraction oil (1) with (2) a heavy fraction oil boiling at not lower than 200° C. obtained at the time of steam cracking of petroleum, the pitch so produced being heat treated to make precursor pitch therein, melt spun, infusibilized and carbonized or further graphitized to obtain the carbon fibers.

5 Claims, No Drawings

STARTING PITCHES FOR CARBON FIBERS

This invention relates to an excellent starting pitch for producing carbon fibers therefrom.

At present, carbon fibers are produced mainly from polyacrylonitrile as the starting material. However, polyacrylonitrile as the starting material for carbon fibers is disadvantageous in that it is expensive, tends not to retain its fibrous shape when heated for infusibilization and carbonization and is carbonized in a low yield.

In view of this, there have recently been reported many methods for producing carbon fibers from pitch. In cases where pitch is used as the starting material for producing carbon fibers, it is expected to obtain carbon fibers at a low cost since pitch is inexpensive and may be carbonized in a high carbonization yield. However, carbon fibers produced from pitch raise a problem that they have high tensile modulus on one hand and low tensile strength on the other hand as compared with those produced from polyacrylonitrile. If, thus, there is found a method for solving said problem and further improving the pitch-derived carbon fibers in tensile modulus, such a method will render it possible to produce carbon fibers having high tensile strength and tensile modulus at a low cost from pitch.

There was recently reported a method for producing carbon fibers having improved tensile modulus and tensile strength, which comprises heat treating a commercially available petroleum pitch to obtain a pitch containing optically anisotropic liquid crystals called "mesophase" (such a pitch being hereinafter referred to as "precursor pitch" in the melt spinning step), melt spinning the thus obtained precursor pitch, infusibilizing (making infusible) the thus melt spun pitch and then carbonizing or further graphitizing the pitch so infusibilized (Japanese Pat. Appln. Laid-Open Gazette No. 49-19127).

However, it depends on various factors whether or not pitch may form liquid crystal therein. In addition, the resulting liquid crystals will greatly depend for their structure, softening point, viscosity and other properties on the pitch used as the starting material. Said Japanese Laid-Open Gazette No. 49-19127 discloses a method for producing a pitch containing the mesophase (such a pitch being hereinafter called "mesophase pitch"), however, it does not refer to anything about a starting pitch for producing a mesophase pitch of good quality therefrom. As mentioned before, it depends greatly on a starting pitch whether or not a mesophase pitch of good quality may be obtained therefrom. If a very desirable starting pitch is obtained, then it will be possible to produce therefrom carbon fibers having excellent tensile modulus and tensile strength. Therefore, it is an important object of this invention to provide such a very desirable starting pitch.

For example, coal tar pitch contains carbon black-like, quinoline-insoluble and infusible substances, and these undesirable substances cause the non-uniformity of the precursor pitch thereby not only degrading the spinnability of the precursor pitch but also having adverse effects on the tensile strength and tensile modulus of the resulting carbon fibers.

In contrast, many of commercially available petroleum pitches and synthetic pitches hardly contain any quinoline-insoluble and infusible substances, however, they will produce quinoline-insoluble and high molecular weight substances when heat treated to prepare a precursor pitch therefrom. More particularly, when these pitches are heat treated, they will cause both thermal decomposition and polycondensation whereby the low molecular weight ingredients gradually form quinoline-insoluble high molecular weight ones. Further, the high molecular weight ingredients so formed will, in turn, form further high molecular weight ones, accompanied with an increase in softening point of the pitches. If these quinoline-insoluble ingredients are similar to the carbon black-type substances in coal tar, they will have adverse effects in the spinning and its subsequent steps as mentioned above. In addition, even if the quinoline-insoluble ingredients are those which are different from said carbon black-like substances, the existence of the quinoline-insoluble substances in a large amount and the increase in softening point in the pitches will have adverse effects in the melt spinning step. More particularly, for melt spinning the precursor pitches, it is necessary to raise the spinning temperature to such an extent that the pitches have a viscosity sufficient to be melt spun. Thus, if the precursor pitches have a too high softening point, then the spinning temperature must naturally be raised with the result that the quinoline-insoluble ingredients form further high molecular weight ones, the pitches cause their pyrolysis with light fraction gases being evolved thereby rendering it impossible to obtain homogeneous pitches and carry out melt spinning of the pitches practically.

As is seen from the above, it is necessary that the precursor pitches have a comparatively low softening point and a viscosity suitable to enable them to be spun. Furthermore, the precursor pitches must not be such that they contain a substantial amount of volatile ingredients at the time of spinning and carbonization.

For this reason, the quinoline-insoluble ingredients are removed by filtration under a pressure, extraction with a solvent, or other suitable means to prepare precursor pitches for producing carbon fibers. However, the methods disclosed in these publications are not desirable from the economical point of view since they require complicated equipment and incur an increased cost.

It is preferable if there may be used, as the starting pitch, an excellent pitch which will not produce quinoline-insoluble high-molecular-weight ingredients when heated for preparing the precursor pitch.

The present inventors made intensive studies in an attempt to obtain such an excellent starting pitch and, as a result of their studies, they obtained an excellent starting pitch. More particularly, they found a starting pitch which will inhibit the production of high molecular weight ingredients, prevent the increase in softening point and be able to have a composition allowing the aromatic planes to be easily arranged in order in the step of preparing precursor pitches.

The starting pitches of this invention which may be used in a method comprising heat treating a starting pitch to obtain a precursor pitch, melt spinning the thus obtained precursor pitch, infusibilizing the thus spun pitch, carbonizing the thus infusibilized pitch and, if desired, graphitizing the thus carbonized pitch to obtain carbon fibers, may be produced by heat treating at 400°–500° C. under a hydrogen pressure of at least 20 $Kg/cm^2.G$ (1) a heavy fraction oil boiling at not lower than 200° C. obtained at the time of fluidized catalytic cracking of petroleum or (3) a mixture of the heavy fraction oil (1) with (2) a heavy fraction oil boiling at not lower than 200° C. obtained at the time of steam cracking of petroleum. The use of the starting pitches of this invention will result in the production of carbon fibers having high tensile modulus and high tensile strength.

After their detailed investigation, the present inventors have found that the most suitable pitches for producing therefrom carbon fibers having high tensile modulus and high tensile strength must be otained by subjecting a specific heavy fraction oil to an extremely limited heat treatment without the use of a hydrogenating catalyst.

In cases where the starting pitch of this invention, produced by heat treating at 400°-500° C. under a hydrogen pressure of at least 20 Kg/cm$^2$.G (1) a heavy fraction oil boiling at not lower than 200° C. obtained at the time of fluidized catalytic cracking of petroleum or (3) a mixture of the oil (1) with (2) a heavy fraction oil boiling at not lower than 200° C. obtained at the time of steam cracking of petroleum as previously mentioned, was subjected to mesophase-forming reaction, it was quite unexpectedly found that the production of quinoline-insoluble ingredients was inhibited, the pitch was reformed and the resulting final product, carbon fibers, had further high tensile modulus and high tensile strength.

In contrast, coal tar pitch, commercially available pitches and synthetic pitches were each heat treated in an attempt to carry out mesophase formation thereon in accordance with the method as disclosed in Japanese Pat. Appln. Laid-Open Gazette No. 49-19127 to obtain heat treated pitches. For example, some of the thus heat treated pitches had a softening point of 340° C. or higher, some thereof contained solid matter deposited therein and some thereof contained at least 70 wt. % of quinoline-insoluble ingredients although they contained no solid matter deposited therein; it is practically impossible in many cases to melt spin these heat treated pitches. As to some of the heat treated pitches, which could be melt spun, they were then infusibilized, carbonized and graphitized to obtain carbon fibers. The thus obtained carbon fibers, however, had a tensile strength of as low as 120-200 Kg/mm$^2$ and a tensile modulus of as low as 12-20 ton/mm$^2$. Furthermore, in a case where the heat treated pitches having a high softening point were melt spun, the resulting fibers had cavities produced due to gases evolved by pyrolysis of the pitches.

This invention will be further detailed hereinbelow.

The heavy fraction oil boiling within at least 200° C. obtained at the time of fluidized catalytic cracking of petroleum according to this invention is a heavy fraction oil boiling preferably within 200° to 450° C. obtained as a by-product at the time of fluidized catalytic cracking of petroleum (such as kerosene, gas oil or a bottom oil obtained by distillation at atmospheric pressure) in the presence of a natural or synthetic silica-alumina catalyst or zeolite catalyst at 450° to 550° C. under atmospheric pressure to 20 Kg/cm$^2$.G.

The heavy fraction oil boiling within at least 200° C. obtained at the time of steam cracking of petroleum according to this invention is a heavy fraction oil boiling preferably within 200°-450° C. obtained as a by-product at the time of steam cracking at usually 700°-1200° C. of petroleum such as naphtha, kerosene or gas oil in order to produce olefins such as ethylene and propylene.

The starting pitches of this invention may be produced by heat treating at 400°-500° C., preferably 405°-450° C., under a hydrogen pressure of at least 20 Kg/cm$^2$.G, for example 20-350 Kg/cm$^2$.G, preferably 50-300 Kg/cm$^2$.G, (1) a heavy fraction oil boiling at at least 200° C. obtained at the time of fluidized catalytic cracking of petroleum or (3) a mixture of the oil (1) with (2) a heavy fraction oil boiling at at least 200° C. obtained at the time of steam cracking of petroleum.

In the above mixture (3), the oils (2) and (1) may be contained in a ratio by weight of 1:0.1-9, preferably 1:0.2-4.

In an attempt to produce the starting pitches of this invention, the use of a heat treating temperature of lower than 400° C. will result in the production of a starting pitch which forms a large amount of quinoline-insoluble ingredients in the step of preparing precursor pitches thereby disadvantageously tending to cause troubles such as coking in the melt spinning step, phase separation and an increase in softening point and producing carbon fibers having inferior properties, while the use of a heat treating temperature of higher than 500° C. will raise problems as to coking and the like in the steps of producing a starting pitch thereby rendering it difficult to produce the starting pitch.

The starting pitches used herein may preferably be subjected to distillation or the like to remove the light fraction if necessary.

The thus obtained pitches of this invention may be heat treated to prepare therefrom precursor pitches having a composition allowing the aromatic planes to be easily arranged in order while inhibiting the production of high-molecular-weight ingredients and preventing an increase in softening point. Thus, the precursor pitches so obtained may be used in producing carbon fibers having very excellent tensile modulus and tensile strength.

The starting pitches of this invention may be used in producing carbon fibers by the use of a conventional known method. More particularly, the starting pitch is heat treated to prepare precursor pitch, after which the precursor pitch so obtained is melt spun, infusibilized and carbonized or further graphitized to obtain carbon fibers.

The heat treatment of the starting pitch to obtain a precursor pitch may usually be carried out at 340°-450° C., preferably 370°-420° C., in the stream of an inert gas such as nitrogen under atmospheric or reduced pressure. The time for the heat treatment may be varied depending on the heat treating temperature, the flow rate of the inert gas, and the like, however, it may usually be 1 minute-50 hours, preferably 1-50 hours, more preferably 3-20 hours. The flow rate of the inert gas may preferably be 0.7-5.0 scfh/lb pitch.

The method of melt spinning the precursor pitch may be a known method such as an extrusion, centrifugal or spraying method. The spinning temperature may usually be 150°-350° C., preferably 200°-330° C.

The pitch fibers obtained by melt spinning the starting pitch are then infusibilized in an oxidizing atmosphere. The oxidizing gases which may usually be used herein, include oxygen, ozone, air, nitrogen oxides, halogen and sulfurous acid gas. These oxidizing gases may be used singly or in combination. The infusibilizing treatment may be effected at such a temperature that the pitch fibers obtained by melt spinning are neither softened nor deformed; thus, the infusibilizing temperature may be, for example, 20°-360° C. The time for the infusibilization may usually be in the range of 5 minutes to 10 hours.

The pitch fibers so infusibilized are then carbonized or further graphitized to obtain carbon fibers. The carbonization may usually be carried out at 800°-2500° C. for generally 0.5 minutes to 10 hours. The further graphitization may be carried out at 2500°-3500° C. for usually 1 second to 1 hour.

Further, the infusibilization, carbonization or graphitization may be effected with some suitable load or tension being applied to the mass to be treated in order to prevent the mass from shrinkage, deformation and the like.

This invention will be better understood by the following non-limitative examples and comparative examples.

EXAMPLE 1

One hundred and fifty (150) milliliters of a heavy fraction oil boiling at 200° C. or higher (as shown in Table 1) obtained as a by-product by fluidized catalytic cracking of gas oil at 500° C. in the presence of zeolite catalyst under 1 Kg/cm$^2$.G, were introduced into a 300-ml autoclave fitted with a stirrer, heated to 430° C. at a temperature-raising rate of 3° C./min. under an initial hydrogen pressure of 100 Kg/cm$^2$.G and then maintained at this temperature for 3 hours, after which the heating was stopped and the mass was cooled to room temperature to obtain a liquid product. The liquid product so obtained was distilled at 250° C. under a pressure of 1 mmHg to distil off the light fraction thereby obtaining a starting pitch of this invention in a yield of 48 wt. %. The pitch so obtained had a softening point of 68° C. and contained 0% of quinoline-insoluble ingredients.

Then, 30 g of the thus obtained starting pitch were heat treated at 400° C. with stirring in a nitrogen stream at a flow rate of 600 ml/min. for 7 hours to obtain a precursor pitch in a yield of 25%. The precursor pitch so obtained had a softening point of 260° C. and contained 10 wt. % of quinoline-insoluble ingredients and 95% of mesophase. The precursor pitch was melt spun at 310° C. by a spinner having 0.3 mm-diameter nozzles and L/D=2 to obtain pitch fibers of 13-16$\mu$ in diameter. The thus obtained pitch fibers were then infusibilized, carbonized and graphitized under the following conditions to obtain carbon fibers.

Infusibilizing conditions: Raised to 200° C. at 3° C./min. and to 300° C. at 1° C./min. and maintained at 300° C. for 15 minutes in air.

Carbonizing conditions: Raised to 1000° C. at 5° C./min. and maintained at this temperature for 30 minutes in a nitrogen atmosphere.

Graphitizing conditions: Raised to 2500° C. at 25° C./min. in an argon stream.

The carbon fibers so obtained had a tensile strength of 260 Kg/cm$^2$ and a tensile modulus of 40 ton/mm$^2$.

The carbon fibers obtained from the starting pitch of this invention have high tensile strength and tensile modulus as compared with those obtained from Ashland 240 which is typical of commercially available petroleum pitches, as is clear from Comparative Example 1 described later.

TABLE 1

| Distillation Characteristics of Heavy Fraction Oil | | |
|---|---|---|
| Specific gravity (15° C./4° C.) | | 0.965 |
| Distillation | Initial boiling point | 320 |

TABLE 1-continued

| Distillation Characteristics of Heavy Fraction Oil | | |
|---|---|---|
| characteristics | 5% | 340 |
| | 10% | 353 |
| | 20% | 370 |
| | 30% | 385 |
| | 40% | 399 |
| | 50% | 415 |
| | 60% | 427 |
| | 70% | 445 |

Comparative Example 1

The procedure of Example 1 was followed except that the starting pitch of this invention was substituted by Ashland 240 LS (softening point 120° C.) which was a commercially available petroleum pitch. The precursor pitch so obtained contained 50% of mesophase.

The carbon fibers thus obtained had a tensile strength of 137 Kg/mm$^2$ and a tensile modulus of 23 ton/mm$^2$.

Comparative Example 2

One hundred and fifty (150) milliliters of the same heavy fraction oil as used in Example 1 were introduced into a 300-ml autoclave provided with a stirrer, heated to 440° C. at a temperature-raising rate of 3° C./min. under an initial nitrogen pressure of 100 Kg/cm$^2$.G and maintained at this temperature for 3 hours, after which the heating was stopped and the mass was cooled to room temperature thereby obtaining a liquid product.

The thus obtained liquid product was distilled at 250° C. under a pressure of 1 mmHg to remove the light fraction therefrom to obtain a starting pitch in a yield of 43 wt. %. The thus obtained starting pitch had a softening point of 80° C. and contained 5 wt. % of quinoline-insoluble ingredients.

Then, 30 g of the starting pitch were heat treated at 400° C. while blowing thereto nitrogen at a flow rate of 600 ml/min. for 5 hours thereby to obtain a pitch having a softening point of 320° C. and containing 40% of quinoline-insoluble ingredients and 90% of mesophase. This pitch was melt spun, infusibilized, carbonized and graphitized in the same manner as in Example 1 thereby to obtain carbon fibers.

The thus obtained carbon fibers had a tensile strength of 145 Kg/mm$^2$ and a tensile modulus of 25 ton/mm$^2$.

EXAMPLE 2

Fifty (50) grams of a heavy fraction oil (1) (as shown in Table 2) boiling at 200° C. or higher obtained by catalytically cracking an Arabian crude oil-derived reduced-pressure gas oil (VGO) in the hydrogenated form at 500° C. in the presence of a silica-alumina catalyst and 100 g of (2) a heavy fraction oil boiling at 200° C. or higher (as shown in Table 3) obtained as a by-product at the time of steam cracking of naphtha at 830° C., were mixed together to form a mixture which was introduced into a 300-ml autoclave provided with a stirrer, heated to 435° C. at a temperature-raising rate of 3° C./min. under an initial hydrogen pressure of 100 Kg/cm$^2$.G and maintained at this temperature for 2.5 hours, after which the heating was stopped and the mixture so heated was cooled to room temperature thereby obtaining a liquid product. The thus obtained liquid product was distilled at 250° C. under a pressure of 1 mmHg to remove the light fraction therefrom to obtain a starting pitch of this invention in a yield of 35 wt. %. The thus obtained starting pitch had a softening point of 63° C. and contained 0% of guinoline-insoluble ingredients.

Then, 30 g of the starting pitch were heat treated at 400° C. under stirring while blowing nitrogen thereto at a flow rate of 600 ml/min. for 10 hours to obtain a precursor pitch in a yield of 47%. The thus obtained pitch had a softening point of 268° C. and contained 27 wt. % of quinoline-insoluble ingredients and 88% of mesophase. This pitch was melt spun at 320° C. by the use of a spinner having 0.3 mm-diameter nozzles and L/D=2 to obtain pitch fibers of 13–16μ in diameter which were then infusibilized, carbonized and graphitized under the following conditions to obtain carbon fibers.

Infusibilizing conditions: Raised to 200° C. at 3° C./min. and then to 300° C. at 1° C./min. and maintained at 300° C. for 15 minutes.

Carbonizing conditions: Raised to 1000° C. at 5° C./min. and maintained at this temperature for 30 minutes.

Graphitizing conditions: Raised to 2500° C. at 25° C./min. in an argon stream.

The thus obtained carbon fibers had a tensile strength of 285 Kg/mm$^2$ and a tensile modulus of 47 ton/mm$^2$.

It is clear that the carbon fibers obtained from the starting pitch of this invention have high strength and high tensile modulus as compared with those obtained from Ashland 240 which is typical of commercially available petroleum pitches as indicated in Comparative Example 3.

TABLE 2

| Distillation Characteristics of Heavy Fraction Oil (1) | | |
|---|---|---|
| Specific gravity (15= C./4° C.) | | 0.965 |
| Distillation Characteristics | Initial boiling point | 320 (°C.) |
| | 5 (%) | 340 |
| | 10 | 353 |
| | 20 | 370 |
| | 30 | 385 |
| | 40 | 399 |
| | 50 | 415 |
| | 60 | 427 |
| | 70 | 445 |
| | 80 | 465 |
| | 90 | 512 |
| Viscosity cSt at 50° C. | | 18.21 |

TABLE 3

| Distillation Characteristics of Heavy Fraction Oil (2) | | |
|---|---|---|
| Specific gravity (15° C./4° C.) | | 1.039 |
| Distillation Characteristics | Initial boiling point | 192 (°C.) |
| | 5 (%) | 200 |
| | 10 | 206 |
| | 20 | 217 |
| | 30 | 227 |
| | 40 | 241 |
| | 50 | 263 |
| | 60 | 290 |
| | 70 | 360 |

Comparative Example 3

The procedure of Example 2 was followed except that the starting pitch of this invention was substituted by Ashland 240 LS (softening point 120° C.) which was typical of commercially available pitches, thereby to obtain carbon fibers. The precursor pitch obtained as the intermediate in this Comparative Example contained 50% of mesophase.

The carbon fibers obtained had a tensile strength of 137 Kg/mm$^2$ and a tensile modulus of 23 ton/mm$^2$.

Comparative Example 4

Fifty (50) grams of the same heavy fraction oil (1) and 100 g of the same heavy fraction oil (2) as used in Example 2, were mixed together to form a mixture which was charged into a 300-ml autoclave provided with a stirrer, heated to 340° C. at a temperature-raising rate of 3° C./min. under an initial hydrogen pressure of 100 Kg/cm$^2$.G and then maintained at this temperature for 3 hours, after which the heating was stopped and the mixture was cooled to room temperature thereby to obtain a liquid product.

The thus obtained liquid product was distilled at 250° C. under a pressure of 1 mmHg to remove the light fraction therefrom to obtain a starting pitch in a yield of 52 wt. %. The thus obtained starting pitch had a softening point of 49° C. and contained 0% of quinoline-insoluble ingredients.

Then, 30 g of this starting pitch were heat treated at 400° C. with stirring while blowing nitrogen at a flow rate of 600 ml/min. for 8 hours thereby to obtain a pitch having a softening point of 325° C. and containing 53 wt.% of quinoline-insoluble ingredients and 90% of mesophase. The yield of this pitch was 34%. There was made an attempt to melt spin said pitch in the same manner as in Example 2, however, it was impossible to carry out the spinning continuously because of non-uniformity of the resulting pitch fibers.

What is claimed is:

1. A process for making carbon fibers comprising heat treating a starting pitch to make a precursor pitch, melt spinning, infusibilizing, carbonizing or further graphitizing said precursor pitch to obtain carbon fibers wherein the starting pitch is produced by heat treating at 400°–500° C. under a hydrogen pressure of at least 20 Kg/cm$^2$.G an oil selected from the group consisting of (1) a heavy fraction oil (A) boiling at not lower than 200° C. obtained as a by-product at the time of fluidized catalytic cracking of petroleum and (2) a mixture of said heavy fraction oil (A) with a heavy fraction oil (B) boiling at not lower than 200° C. obtained at the time of steam cracking of petroleum, the ratio by weight between said heavy fraction oil (B) to said heavy fraction oil (A) being 1 to 0.1–9.

2. The process for making carbon fibers according to claim 1, wherein the heavy fraction oils (A) and (B) are each boiling at 200°–450° C.

3. The process for making carbon fibers according to claim 1 or 2 wherein the petroleum used in the catalytic or steam cracking is naphtha, gas oil, kerosene, or a bottom oil obtained by distillation at atmospheric pressure.

4. The process according to claim 1 wherein the ratio by weight of said heavy fraction (B) to said heavy fraction oil (A) is 1:0.2–4.

5. The process according to claim 1 wherein said starting pitch is distilled to remove the light fraction prior to melt spinning.

* * * * *